US011127551B2

(12) United States Patent
Ye et al.

(10) Patent No.: US 11,127,551 B2
(45) Date of Patent: Sep. 21, 2021

(54) CIRCUIT BREAKER AND METHOD OF PERFORMING A CURRENT BREAKING OPERATION

(71) Applicant: ABB Power Grids Switzerland AG, Baden (CH)

(72) Inventors: Xiangyang Ye, Nesselnbach (CH); Bernardo Galletti, Nussbaumen (CH); Mahesh Dhotre, Brugg (CH); Manuel Gotti, Turgi (CH); Martin Seeger, Safenwil (CH)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/766,430

(22) PCT Filed: Dec. 18, 2018

(86) PCT No.: PCT/EP2018/085565
§ 371 (c)(1),
(2) Date: May 22, 2020

(87) PCT Pub. No.: WO2019/121732
PCT Pub. Date: Jun. 27, 2019

(65) Prior Publication Data

US 2021/0043401 A1 Feb. 11, 2021

(30) Foreign Application Priority Data

Dec. 20, 2017 (EP) ..... 17209152

(51) Int. Cl.
*H01H 33/70* (2006.01)
*H01H 1/14* (2006.01)

(52) U.S. Cl.
CPC ..... *H01H 33/703* (2013.01); *H01H 1/14* (2013.01)

(58) Field of Classification Search
CPC .... H01H 1/14; H01H 33/703; H01H 33/7023; H01H 33/56; H01H 33/7038;
(Continued)

(56) References Cited

U.S. PATENT DOCUMENTS 7,956,306 B2 * 6/2011 Ye ..... H01H 33/74 218/76
8,598,483 B2 * 12/2013 Dienemann ..... H01H 33/901 218/53

(Continued)

FOREIGN PATENT DOCUMENTS

CN 101162663 * 11/2013 ..... H01H 33/88
DE 756203 C 5/1953

(Continued)

OTHER PUBLICATIONS

Translation of CN101162663 (Original documents published Nov. 27, 2013) (Year: 2013).*

(Continued)

*Primary Examiner* — William A Bolton
(74) *Attorney, Agent, or Firm* — Sage Patent Group

(57) ABSTRACT

A circuit breaker includes: first and second contacts moveable relative to each other along an axis of the circuit breaker between an open and closed configuration and defining an arcing region in which an arc is formed during current breaking operation; a nozzle directing a flow of quenching gas onto the arcing region during current breaking operation, a diffusor downstream of the nozzle for further transporting the quenching gas within the arcing region and/or downstream of the arcing region, and a mechanical swirling device arranged downstream of the nozzle and at least partially in the diffusor for imparting a swirl onto the quenching gas flowing along the diffusor, the mechanical
(Continued)

swirling device having an axial overlap with the second contact in the open configuration of the circuit breaker.

20 Claims, 7 Drawing Sheets

(58) Field of Classification Search
CPC ..... H01H 33/7046; H01H 33/7053; H01H 33/7069; H01H 33/91; H01H 33/95; H01H 1/385; H01H 33/121; H01H 2033/566
USPC ..... 218/53, 54, 62, 63, 72
See application file for complete search history.

(56) References Cited

U.S. PATENT DOCUMENTS

| | | | | |
|---|---|---|---|---|
| 9,035,211 | B2 * | 5/2015 | Schiffbauer | H01H 33/82 218/43 |
| 9,673,006 | B2 * | 6/2017 | Hermosillo | H01H 33/74 |
| 2005/0150868 | A1 * | 7/2005 | Nowakowski | H01H 33/91 218/57 |
| 2008/0192389 | A1 * | 8/2008 | Muench | H02H 1/0023 361/5 |
| 2008/0314873 | A1 * | 12/2008 | Dahlquist | H01H 33/7023 218/53 |
| 2013/0265693 | A1 * | 10/2013 | Panousis | H01H 33/7015 361/634 |
| 2016/0133407 | A1 * | 5/2016 | Nomura | H01H 33/703 218/46 |

FOREIGN PATENT DOCUMENTS

| | | | | |
|---|---|---|---|---|
| DE | 3543762 | A1 | 11/1986 | |
| DE | 102015101622 | A1 | 8/2016 | |
| DE | 102016105539 | A1 | 9/2017 | |
| FR | 2954995 | A1 | 7/2011 | |
| JP | 10312730 | * | 11/1998 | H01H 33/91 |
| WO | WO 2014/154292 | A1 | 10/2014 | |
| WO | WO 2017/207763 | A1 | 12/2017 | |

OTHER PUBLICATIONS

Translation of DE102016105539 (Original documents published Sep. 28, 2017) (Year: 2017).*
Translation of JP10312730 (Original document published Nov. 24, 1998) (Year: 1998).*
International Search Report and Written Opinion of the International Searching Authority, PCT/EP2018/085565, dated Jan. 18, 2019, 10 pages.
International Preliminary Report on Patentability, PCT/EP2018/085565, dated Jun. 23, 2020, 7 pages.
European Search Report, EP 17209152.2, dated May 18, 2018, 6 pages.

* cited by examiner

CIRCUIT BREAKER AND METHOD OF PERFORMING A CURRENT BREAKING OPERATION

This application is a 35 U.S.C. § 371 national stage application of PCT International Application No. PCT/EP2018/085565 filed on Dec. 18, 2018, which in turns claims foreign priority to European Patent Application No. 17209152.2, filed on Dec. 20, 2017, the disclosures and content of which are incorporated by reference herein in their entirety.

Aspects of the invention relate to a circuit breaker, in particular a circuit breaker having a mechanical swirling device. Further aspects relate to a method of performing a current breaking operation.

TECHNICAL BACKGROUND

A circuit breaker can be an automatically operated electrical switch designed to protect an electrical circuit from damage caused by excess current, typically resulting from an overload or short circuit. Its basic function may be to interrupt current flow after a fault is detected. To interrupt current flow, the circuit breaker is normally opened by relative movement of the contacts (plug and pipe) away from each other, whereby an arc can form between the separating contacts. In order to extinguish such an arc, some types of switches are equipped with an arc-extinguishing system. In one type of switch, an arc-extinguishing system operates by releasing a quenching gas towards the arc for cooling down and finally extinguishing the arc. However, the contacts may form a barrier that may deteriorate the flow of the quenching gas released towards the arc, whereby hot zones may be formed in which the temperature of the quenching gas is increased. Thus, there is a need for an improved circuit breaker that is at least partially able to clear the zones of hot gas.

SUMMARY OF THE INVENTION

In view of the above, a circuit breaker according to claim 1, and a method of performing a current breaking operation according to claim 14 are provided. Embodiments are disclosed in the dependent claims, claim combinations and in the description together with the drawings.

According to an aspect, a circuit breaker is provided. The circuit breaker includes first and second contacts being configured to be moveable with respect to each other along an axis of the circuit breaker between an open and a closed configuration of the circuit breaker, the first and second contacts defining an arcing region in which an arc is formed during a current breaking operation; a nozzle configured for directing a flow of a quenching gas onto the arcing region during the current breaking operation, a diffusor arranged downstream of the nozzle for further transporting the quenching gas within the arcing region and/or downstream of the arcing region, and a mechanical swirling device being arranged downstream of the nozzle and at least partially in the diffusor for imparting a swirl onto the quenching gas flowing along the diffusor, the mechanical swirling device having an axial overlap with the second contact in the open configuration of the circuit breaker.

According to a further aspect a method of performing a current breaking operation is provided. The method cam be performed by a circuit breaker according to the above aspect. The method includes: separating the first and second contacts from each other by relative movement away from each other along the axis of the switch, so that an arc is formed in the arcing region between the first and second contacts; and blowing a swirl flow of a quenching gas onto the arcing region.

An advantage is that zones of hot quenching gas or hot zones may be decreased due to imparting a swirl flow onto the quenching gas.

Further advantages, features, aspects and details that can be combined with embodiments described herein are evident from the dependent claims, the description and the drawings.

BRIEF DESCRIPTION OF THE FIGURES

The details will be described in the following with reference to the figures, wherein.

DETAILED DESCRIPTION OF THE FIGURES AND OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

Figure 1:
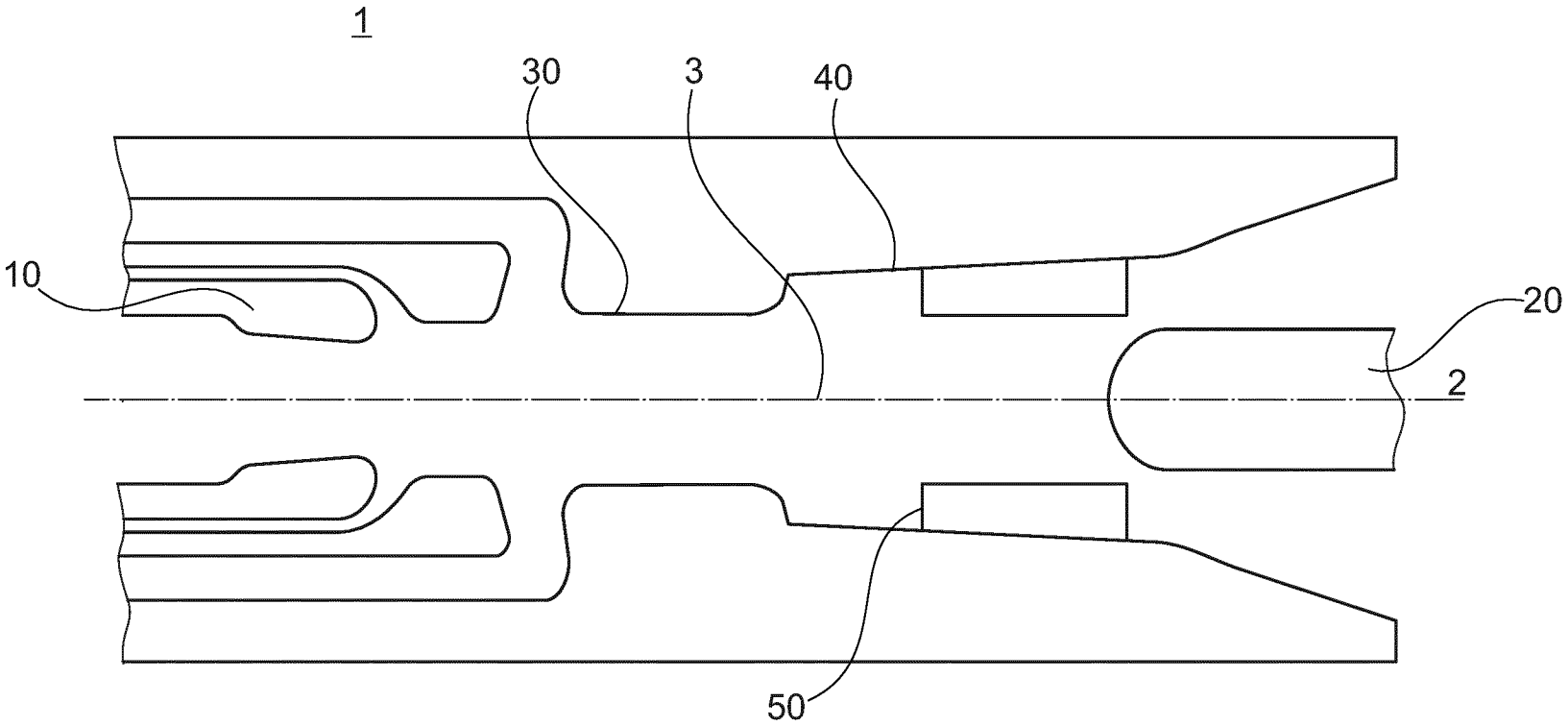
FIG. 1 shows a cross-sectional view of a circuit breaker according to embodiments described herein.

FIG. 1 shows a cross sectional view of a circuit breaker 1 according to embodiments described herein. The circuit breaker 1 can be configured for a rated operating voltage of at least 73 kV.

The circuit breaker 1 can include a first contact 10 and/or a second contact 20. The first contact 10 and/or second contact 20 can be configured to be moveable with respect to each other, specifically along an axis 2 of the circuit breaker.

In particular, the first contact 10 and/or second contact 20 can be configured to be moveable with respect to each other between an open configuration and a closed configuration of the circuit breaker 1.

The circuit breaker 1 can have a gas-tight housing. The gas-tight housing can have an inner volume. The inner volume can be filled with an electrically insulating gas, e.g. at an ambient pressure. The first contact 10 and/or the second contact can be arranged in the housing and/or the inner volume.

In the open configuration, the first contact 10 and/or second contact 20 can be separated from each other. In particular, in the open configuration, the first contact 10 and/or second contact 20 can be separated from each other such that no current flows between the first contact 10 second contact 20.

In the closed configuration, the first contact 10 and/or second contact 20 can contact each other. In particular, in the open configuration, the first contact 10 and/or second contact 20 can contact each other such that a current flows between the first contact 10 second contact 20. That is, a galvanic connection may be formed between the first contact 10 and/or second contact 20 in the closed configuration. According to embodiments described herein, the first contact 10 can be a tulip-type contact and/or the second contact 20 can be a pin-type contact. In such a case, the second contact 20 can be inserted into the first contact 10.

The movement from the closed configuration to the open configuration can be defined as a current breaking operation. During the current breaking operation, an arc can be formed between the first contact 10 and/or the second contact 20. In particular, the first contact 10 and/or the second contact 20 can define the arcing region 3 in which the arc is formed during the current breaking operation.

The circuit breaker 1 can include a nozzle 30. The nozzle 30 can be configured for directing a flow of a quenching gas onto the arcing region 3 during the current breaking operation. The quenching gas can be a portion of the insulation gas contained in the inner volume of the circuit breaker. Further, the quenching gas can be pressurized to be directed onto the arcing region 3.

For instance, insulating gas can be pressurized upstream of the nozzle 30, e.g. by an arc-extinguishing system, and directed through the nozzle 30 and downstream of the nozzle 30.

A diffuser 40 can be arranged downstream of the nozzle 30. The diffuser 40 can be configured for further transporting the quenching gas within the arcing region 3 and/or downstream of the arcing region 3.

The quenching gas transported into, within and/or downstream of the arcing region 3 can have a quenching gas flow. Ideally, the quenching gas flow can be considered as laminar. However, the quenching gas flow can be deteriorated, e.g. by the first contact 10 and/or the second contact 20. A deterioration from the laminar flow may lead to a turbulent flow. Accordingly, the quenching gas transported into, within and/or downstream of the arcing region 3 may at least partially include a turbulent flow. Such a turbulent flow may, e.g., occur in front to the second contact 20.

According to embodiments described herein, a mechanical swirling device 50 can be arranged downstream of the nozzle 30. In particular, the mechanical swirling device 50 can be arranged downstream of the nozzle 30 at a distance from the nozzle 30. The mechanical swirling device 50 can be arranged at least partially in the diffusor 40. In particular, the mechanical swirling device 50 can be arranged at least partially in the diffusor 40 for imparting a swirl onto the quenching gas flowing along the diffusor 40. The mechanical swirling device 50 can have an axial overlap with the second contact 20. In particular, the mechanical swirling device 50 can have an axial overlap with the second contact 20 in the open configuration of the circuit breaker 1. Additionally or alternatively, the mechanical swirling device 50 can have an axial overlap with the second contact 20 in the closed configuration of the circuit breaker 1.

According to embodiments described herein, the swirling device 50 can be configured to create the swirl and the swirling flow can create a centrifugal force on the flow of the quenching gas. In particular, the swirling device 50 can be configured to create a centrifugal force on the quenching gas transported into, within and/or downstream of the arcing region 3. The centrifugal force may lead to a centrifugal flow component of the quenching gas. In the context of the present application, a "centrifugal flow component" of the quenching gas may be understood as being radially with respect to the axis 2 of the circuit breaker 1. Accordingly, the quenching gas may be imparted with a flow component that leads the quenching gas away from the second contact 20, in particular a front region of the second contact 20. By practicing embodiments, the generation of hot zones can be reduced.

Figure 2A:
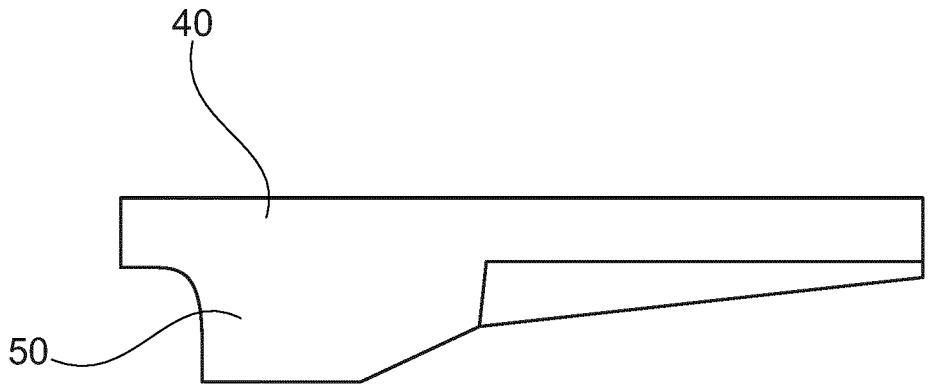
FIGS. 2A-2B show cross-sectional views of details of a circuit breaker according to embodiments described herein.
Figure 2B:
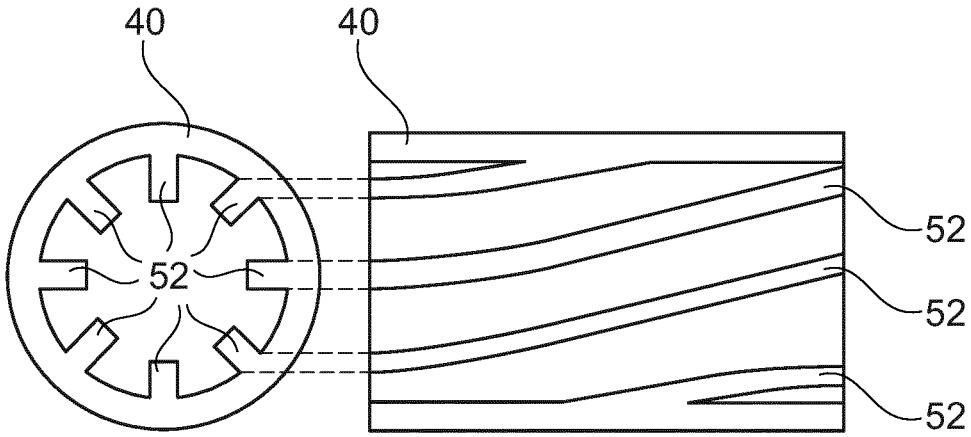

FIGS. 2A and 2B show cross-sectional views of details of a circuit breaker 1 according to embodiments described herein. In particular, FIGS. 2A and 2B show a mechanical swirling element 50 being inserted in the diffusor 40. FIG. 2A shows a cross-sectional view along the axis 2. FIG. 2B shows two cross cross-sectional views, the one on the left hand side normal to the axis 2 and the one on the right hand side along the axis 2. As shown in FIG. 2A, the mechanical swirling element 50 can be inserted in the diffusor 40. For instance, the swirling element 50 can be fixed in and/or to the diffusor 40, e.g. by screwing, gluing, clamping, etc.

Further, FIG. 2B shows that the mechanical swirling device 50 can include mechanical swirling elements 52. In particular, the mechanical swirling device 50 can include any number of mechanical swirling elements 52, such as one, two, more than two and/or a plurality of mechanical swirling elements 52. The mechanical swirling elements 52 can be configured to mechanically deflect the flow of the quenching gas. According to embodiments described herein, the mechanical swirling elements 52 can be fixed to the diffusor 40.

The mechanical swirling elements 52 can have a shape. The shape can vary along the axis 2 and/or orthogonal to the axis 2. Further, the shape can be bent or straight. Furthermore, the mechanical swirling elements 52 can have a constant thickness, a radially varying thickness, to and/or an axially varying thickness. Moreover, the mechanical swirling elements 52 can be arranged parallel to each other and/or non-parallel with respect to each other.

According to embodiments described herein, the mechanical swirling elements 52 can include and/or be blades. In the context of the present disclosure, a "blade" can be understood as an element having an elongated shape, which may have a taper and/or a bend along its extension. According to embodiments described herein, the mechanical swirling elements 52 can include a first portion 52*a* being inclined with respect to the axis 2 and/or a second portion 52*b* being substantially parallel to the axis 2. The first portion 52*a* can be connected to the diffuser 40. The first and second portions 52*a*, 52*b* can be continuously joined to each other. By practicing embodiment, a centrifugal force on the flow of the quenching gas can be created.

Figure 3B:
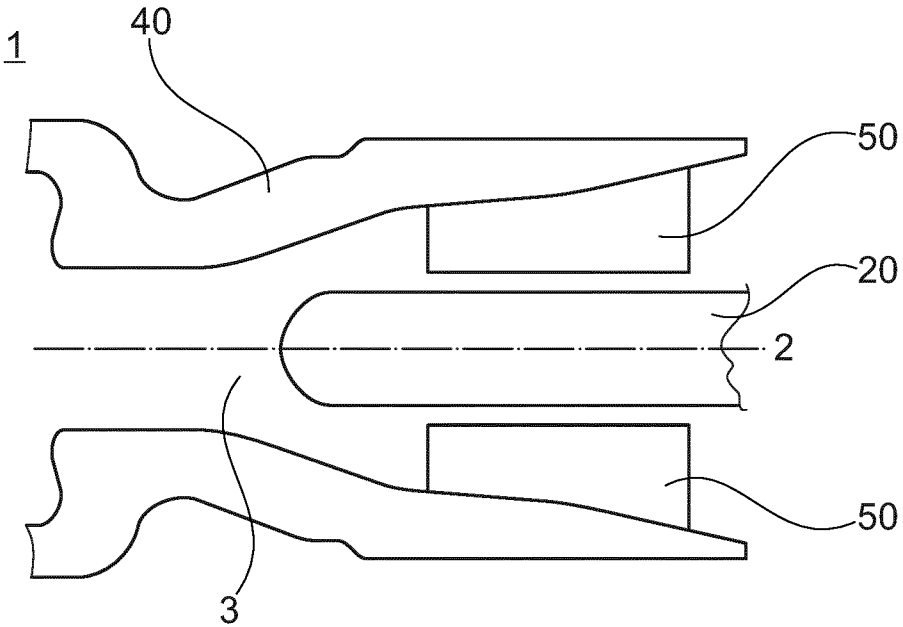
FIGS. 3A-3B show a perspective view of details of a mechanical swirling device of a circuit breaker according to embodiments described herein and a circuit breaker including the mechanical swirling device according to embodiments described herein.
Figure 3A:
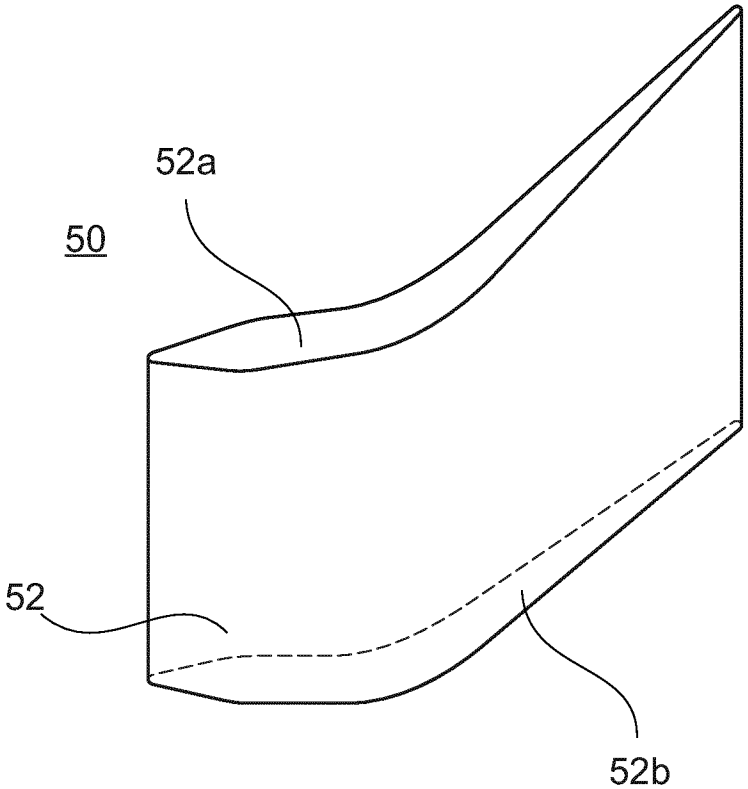

FIGS. 3A and 3B show a perspective view of details of a mechanical swirling device 50 of a circuit breaker 1 according to embodiments described herein and a circuit breaker 1 including the mechanical swirling device 50 according to embodiments described herein.

The mechanical swirling elements 52 shown in FIG. 3A can be considered as being shaped like blades. Accordingly, they can include a first portion 52*a* being connected to the diffuser 40 and/or inclined with respect to the axis 2 and/or a second portion 52*b* being substantially parallel to the axis 2. The first and second portions 52*a*, 52*b* can be continuously joined to each other.

Further, the first portion 52*a* can have a mean thickness that is greater than a mean thickness of the second portion 52*b*. Specifically, the mechanical swirling element 52 can have a taper, which may decrease the thickness of the mechanical swirling element 52 from the first portion 52*a* to the second portion 52*b*.

According to embodiments described herein, the mechanical swirling device 50, specifically the mechanical swirling elements 52, can be made from and/or include an insulating material. Additionally or alternatively, to embodiments described herein, the mechanical swirling device 50, specifically the mechanical swirling elements 52, can be made from and/or include the same material as the nozzle 30 and/or the diffusor 40.

In the case the mechanical swirling device 50, specifically the mechanical swirling elements 52, include and/or are made from the same material as the nozzle 30 and/or the diffusor 40, the mechanical swirling device 50, specifically the case the mechanical swirling elements 52, can be integrally manufactured with the diffusor 40, i.e. in one piece, e.g. by 3D printing. FIG. 3B shows the mechanical swirling device 50, specifically the case the mechanical swirling elements 52, being integrally formed with the diffusor 40. By practicing embodiments, a stable and reliable circuit breaker with less manufacturing steps can be provided.

Figure 4B:
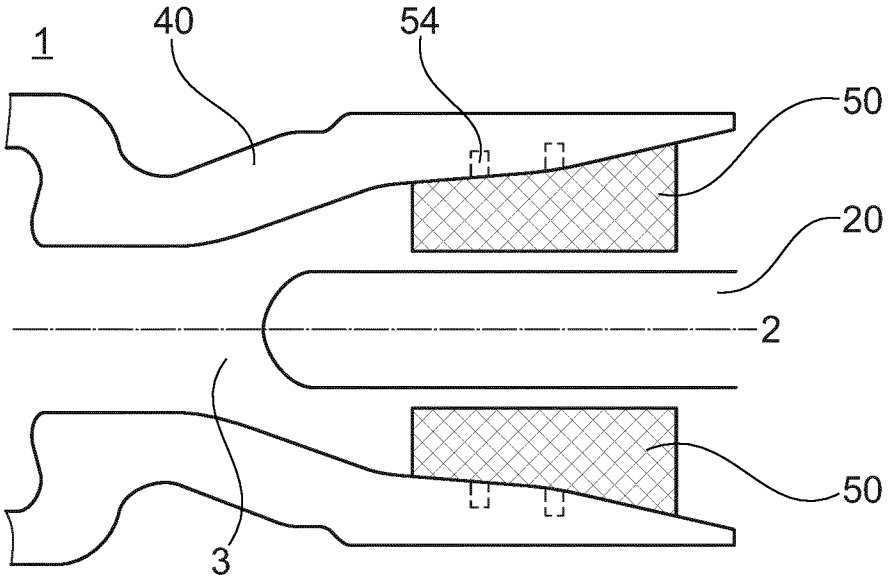
FIGS. 4A-4B show a perspective view of details of a mechanical swirling device of a circuit breaker according to embodiments described herein and a circuit breaker including the mechanical swirling device according to embodiments described herein.
Figure 4A:
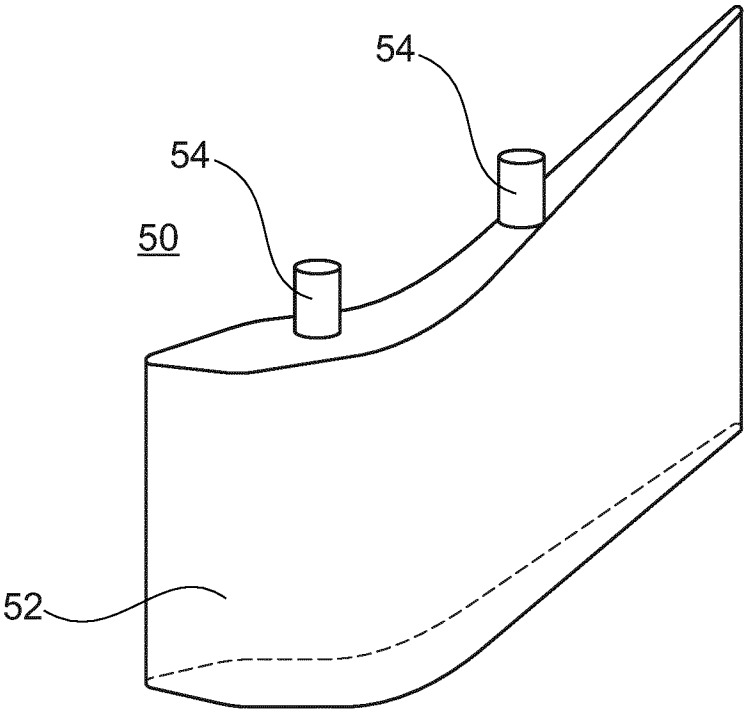

FIGS. 4A-4B show a perspective view of details of a mechanical swirling device 50 of a circuit breaker 1 according to embodiments described herein and a circuit breaker 1 including the mechanical swirling device 50 according to embodiments described herein.

According to embodiments described herein, the mechanical swirling device 50, specifically the mechanical swirling elements 52, can include attachment elements 54. The attachment elements 54 can fixedly attach the mechanical swirling device 50, specifically the mechanical swirling elements 52, to the diffusor 40. For instance, the attachment elements 54 can be fixation cylinders. The attachment elements 54 can be provided at a side surface of the mechanical swirling elements 52. Specifically, the attachment elements 54 can be provided at the side surface of the mechanical swirling elements 52, by which the attachment elements 54 can be fixedly attached to the diffusor 40. For instance, the swirling device 50, specifically the mechanical swirling elements 52, can be glued with the attachment elements 54 in the diffusor 40 (see FIG. 4B). According to embodiments described herein, the mechanical swirling elements 52 are fixed to the diffusor 40. By practicing embodiments, a system for upgrading existing circuit breakers may be provided.

Figure 5B:
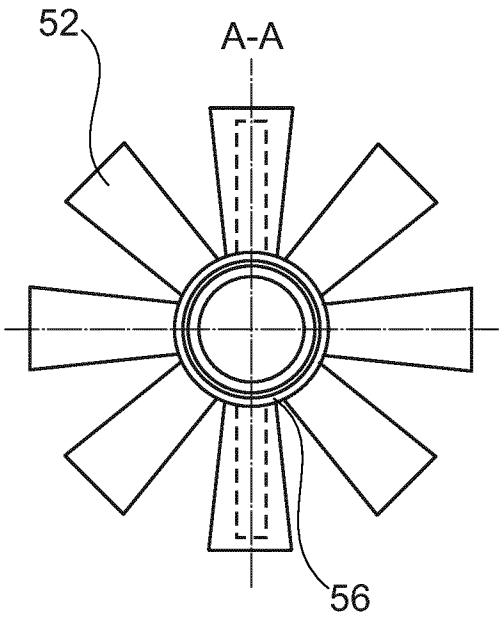
FIGS. 5A-5B show cross-sectional views of a circuit breaker according to embodiments described herein.
Figure 5A:
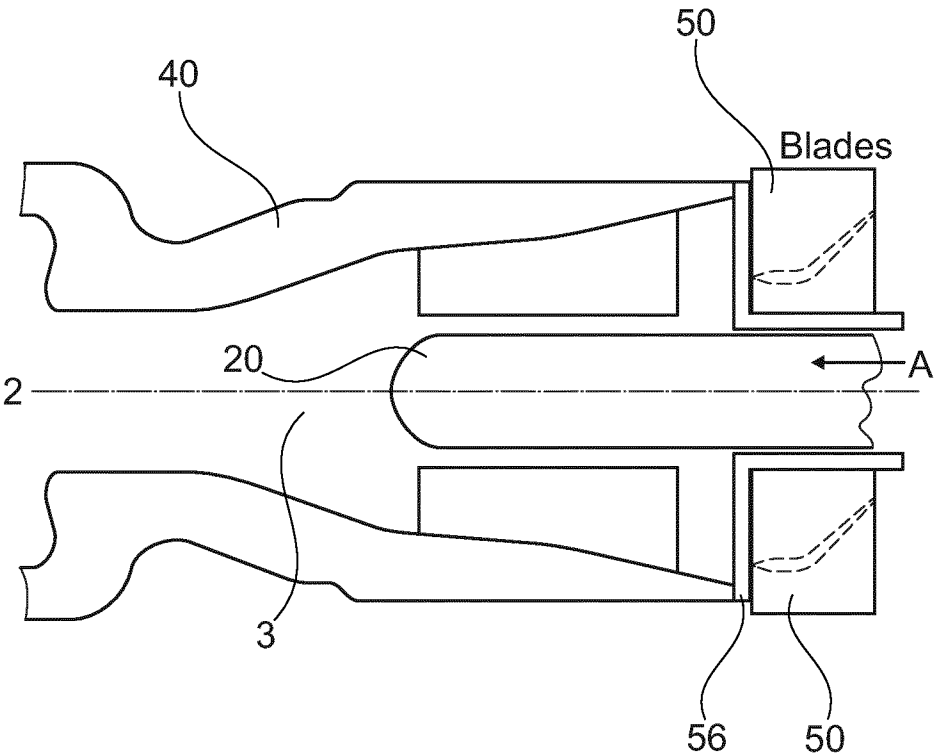

FIGS. 5A-5B show cross-sectional views of a circuit breaker 1 according to embodiments described herein. Specifically, FIG. 5A shows a cross-sectional view of a circuit breaker 1 along the axis 2, and FIG. 5B shows a cross-sectional view of the circuit breaker 1 orthogonal to the axis 2.

According to embodiments described herein, the circuit breaker 1 can include a support 56. The support 56 can be configured to mount the mechanical swirling device 50, specifically the mechanical swirling elements 52, to the diffusor 40. For instance, the support 56 can be provided at a downstream side of the diffusor 40, specifically at a downstream exit of the diffusor 40.

The support 56 can be made from and/or include an insulating material, such as Teflon or a non-insulating material, such as metal, for instance steel. Specifically in case the support 56 is made from an insulating material, the mechanical swirling device 50, specifically the mechanical swirling elements 52, can be made from and/or include a non-insulating material, such as metal.

According to embodiments described herein, the mechanical swirling device 50, specifically the mechanical swirling elements 52, can be fixedly attached to the support 56. Alternatively, the mechanical swirling device 50, specifically the mechanical swirling elements 52, can be rotatably provided to the support 56. In this case the mechanical swirling device 50, specifically the mechanical swirling elements 52, may rotate around the axis 2. Additionally or alternatively, the support 56 can be configured to provide a rotation function. For instance, the support 56 can include a bearing or the like. Accordingly, a first part of the support 56 may be fixedly connected to the diffusor 40 and/or a second part of the support 56 may be fixedly connected to the mechanical swirling device 50, specifically the mechanical swirling elements 52. The first part of the support 56 can be provided rotatably with respect to the second part of the support 56.

According to embodiments described herein, the mechanical swirling elements 52 can be arranged symmetrically around the axis 2. Specifically, the mechanical swirling elements 52 can be arranged rotationally symmetrically around the axis 2, i.e. with an n-fold rotational symmetry with n being an integer, e.g. n=8. Further, the mechanical swirling elements 52 can be arranged with a constant or non-constant (i.e. variable) pitch.

According to embodiments described herein, the diffusor 40 and/or the mechanical swirling device 50 can be fixedly attached to the first contact 10. Accordingly, due to the relative movement between the first contact 10 and the second contact 20 in the transition from the open configuration to the closed configuration, and vice versa, the axially overlap of the mechanical swirling device 50 and the second contact 20 may vary during this movement.

Figure 6:
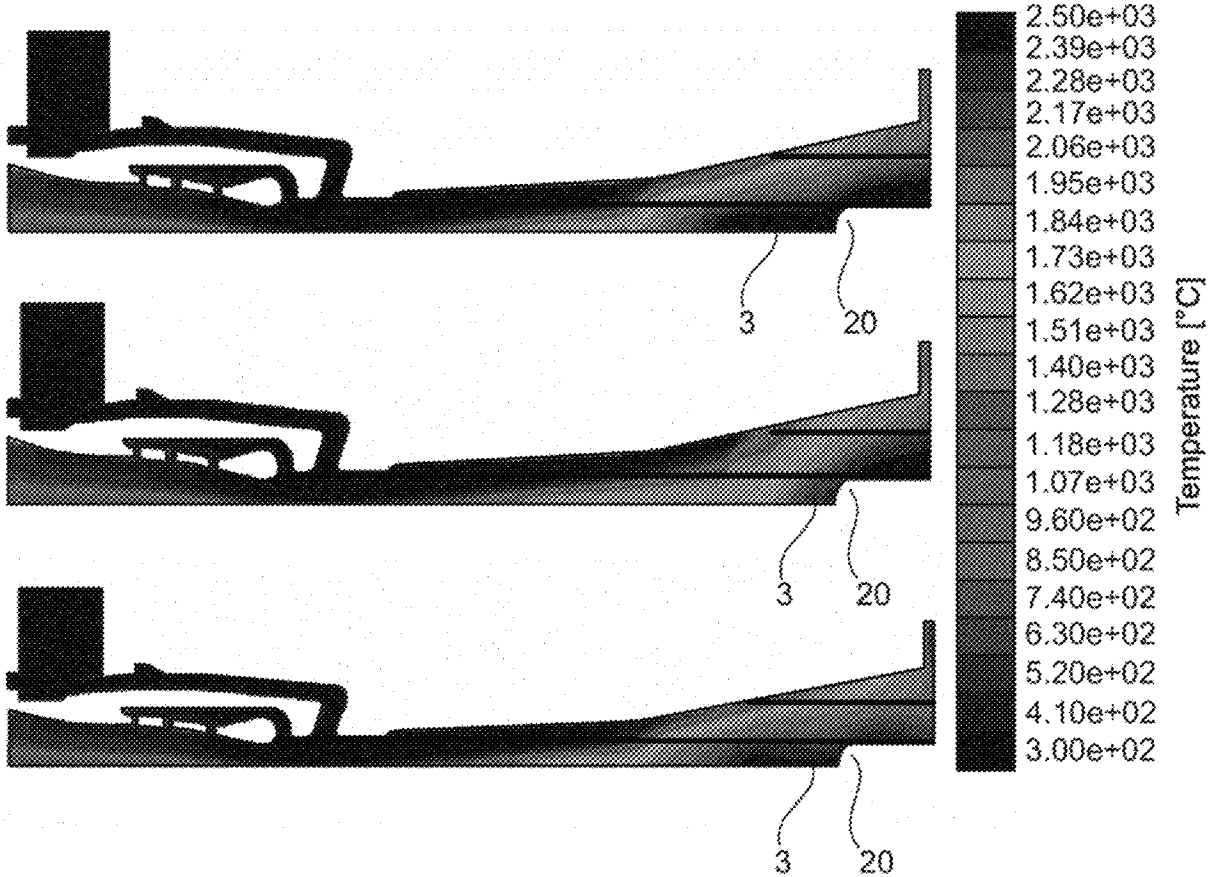
FIG. 6 shows three heat maps illustrating the temperature distribution of a quenching gas in a circuit breaker according to embodiments described herein for differently positioned mechanical swirling devices.

FIG. 6 shows three heat maps illustrating the temperature distribution of a quenching gas in a circuit breaker 1 according to embodiments described herein for differently positioned mechanical swirling devices. Specifically, FIG. 6 shows three heat maps for a side of the circuit breaker above the axis 2 illustrating the temperature distribution of the quenching gas in this regions at a time of 17.6 ms after disconnection. The second contact 20 and the arching region 3 is shown in FIG. 6.

The top view in FIG. 6 shows a reference heat map without the mechanical swirling device 50. The middle view in FIG. 6 shows heat map with a mechanical swirling device 50 arranged at least partially upstream of the second contact 20, i.e. an upstream end of the mechanical swirling device 50 is arranged upstream of an upstream end of the second contact 20. The bottom view in FIG. 6 shows a heat map with a mechanical swirling device 50 arranged at least partially downstream of the second contact 20, i.e. an upstream end of the mechanical swirling device 50 is arranged downstream of an upstream end of the second contact 20.

As can be seen from the top view in FIG. 6, a zone of hot quenching gas occurs in the arching region 3, particularly in front of the second contact 20, i.e. in front of an upstream end of the second contact 20. This hot zone may create a turbulent flow of quenching gas in front of the second contact 20 and/or may lead to a deterioration of the circuit breaker 1, resulting in a reduced life time and/or prolong the duration for extinguishing the arc.

As can be seen from the middle and bottom views in FIG. 6, the hot zone, i.e. its temperature and size, can be reduced by the mechanical swirling device 50. In particular, it can be seen that for both position, upstream and downstream, the hot zone can be reduced. Without being wanted to be bound by theory, it is assumed that due to the transportation of the quenching gas within the arcing region and/or downstream of the arcing region 3, the mechanical swirling device 50 does not only swirl the quenching gas downstream of the mechanical swirling device 50, but also upstream of the mechanical swirling device 50, e.g. by a suction effect and/or by a backward swirling of the quenching gas.

Figure 7:
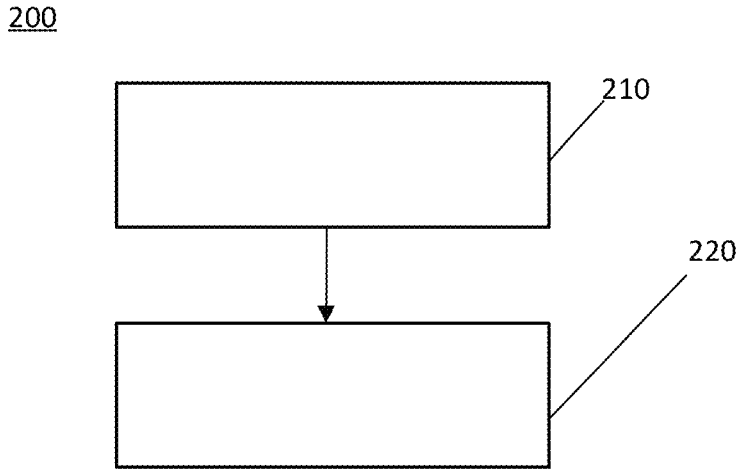
FIG. 7 shows a method of performing a current breaking operation by the circuit breaker according to embodiments described herein.

FIG. 7 shows a method 200 of performing a current breaking operation by the circuit breaker 1 according to embodiments described herein. In a first block 210, the first and second contacts 10, 20 can be separated from each other by a relative movement away from each other along the axis 2 of the circuit breaker 1, so that an arc is formed in the arcing region 3 between the first and second contacts 10, 20. In block 220, a swirl flow of a quenching gas is blown onto the arcing region 3. In the context of the present application "blowing a swirl flow of a quenching gas onto the arcing region" can also include the case in which the mechanical swirling device 50 is arranged downstream of the second contact 20 and/or the arcing region 3. As described herein, also the downstream position of the mechanical swirling device 50 provides the effect of swirling the quenching gas and/or reducing the hot zones. Accordingly, the phrase "blowing a swirl flow of a quenching gas onto the arcing region" also encompasses this configuration.

Next, general aspects of embodiments are described. Therein, the reference numbers of the Figures are used merely for illustration. The aspects are, however, not limited to any particular embodiment. Instead, any aspect described herein can be combined with any other aspect(s) or embodiments described herein unless specified otherwise.

These advantages are not limited to the embodiments shown in FIGS. 1 to 7, but the circuit breaker 1 can be modified in a plurality of ways. In the following, some general preferred aspects are described. These aspects allow for a particularly beneficial creating of a swirl flow, arc extinction and/or reduction of hot zones due to a synergy with the presence of the mechanical swirling device 50. The description uses the reference signs of FIGS. 1 to 7 for illustration, but the aspects are not limited to these embodiments. Each of these aspects can be used only by itself or combined with any other aspect(s) and/or embodiment(s) described herein.

First, aspects regarding the contacts 10 and 20 are described.

According to an aspect, the first contact 10 can have a tube-like geometry. The second contact 20 can have a pin-like geometry and can, in the closed configuration, be inserted into the first contact 10.

According to a further aspect, the circuit breaker 1 can be of single-motion type. According to an aspect, the first contact 10 can be a movable contact and may be moved along the axis 2 away from the second (stationary) contact 20 for opening the switch. The first contact 10 can be driven by a drive.

According to a further aspect, the first and second contacts 10, 20 may have arcing portions for carrying an arc during a current breaking operation. The arcing portions can define the quenching region 3 in which the arc develops. According to an aspect, the first contact 10 can have an insulating nozzle tip on a distal side of its arcing portion. Additionally or alternatively, the arcing portion of the second contact can be arranged at a distal tip portion of the second contact 20.

According to a further aspect, the first and second arcing contact portions can have a maximum contact separation of up to 150 mm, preferably up to 110 mm, and/or of at least 10 mm, and preferably of 25 to 75 mm.

Next, aspects regarding the mechanical swirling device 50 are described.

According to an aspect, the mechanical swirling device 50, specifically the mechanical swirling elements 52, can be (arranged) mirror-symmetric(ally) or non-mirror symmetric (ally) and/or can have a chirality (left- or right-handedness). The chirality can be defined by the handedness of a torque imparted onto the gas flow by the interaction with the swirling device 50.

According to a further aspect, the mechanical swirling device 50 can have non-mirror-symmetric mechanical swirling elements 52, in the sense that the mechanical swirling elements 52 define a preferred rotational orientation (left- or right-handed), and thus the swirl flow, of the quenching gas passing along the mechanical swirling elements 52. According to an aspect, the mechanical swirling elements 52, or at least a portion of the mechanical swirling elements 52, can be inclined by a predetermined angle in a (predominantly) circumferential direction (the predetermined angle can be more than 0° but less than 90°), so that the quenching gas flowing along the mechanical swirling elements 52 is imparted with the swirling torque. The circumferential inclination direction, and preferably the circumferential inclination angle, of each of the guide elements can be the same.

According to a further aspect, the mechanical swirling elements 52 can be partially axially extending, so that the quenching gas flows along the mechanical swirling elements 52 with an axial component. Alternatively or in addition, the mechanical swirling elements 52 may be partially radially extending, so that the quenching gas flows along the mechanical swirling elements 52 with a radial component. Alternatively or in addition, the mechanical swirling elements 52 may be partially azimuthally extending, so that the quenching gas flows along the mechanical swirling elements 52 with an azimuthal component.

According to a further aspect, the swirling device 50, specifically the mechanical swirling elements 52, can be concentrically arranged with a center axis 2 of the circuit breaker 1. According to a further aspect, the swirling device 50, specifically the mechanical swirling elements 52, can be are arranged at an off-axis position with respect to the axis 2 of the circuit breaker 1.

According to a further aspect, the mechanical swirling device 50 can be fixed to the first contact 10 (specifically with no movable components with respect to the first contact 10).

Next, aspects regarding the nozzle 30 are described, which allow for a particularly beneficial creation of a swirl flow, arc extinction and/or reduction of hot zones with the mechanical swirling device 50.

According to an aspect, the nozzle 30 can be fixedly joined to the first (movable) contact 10 and/or co-moveable with the first contact 10 and/or driven by the drive unit which drives the first contact 10.

According to a further aspect, the nozzle 30 can be tapered (at least in a section thereof) such that a final diameter at the exit (downstream side) of the nozzle 30 can be smaller than a diameter at an upstream portion (e.g. entrance portion) of the nozzle 30. According to a further aspect, the nozzle 30 can have a first channel section of larger diameter and a second channel section of smaller diameter downstream of the first channel section. Thereby, an accelerated flow of quenching gas at the exit of the nozzle 30 may be generated in practice. In this context, the diameter can be defined as the (largest) inner diameter of the respective section. Furthermore, "upstream" and "downstream" may herein refer to the flow direction of the quenching gas during a current breaking operation.

According to a further aspect, the diameter of the nozzle 30 can be continuously (i.e. in a non-stepwise manner) reduced from the first channel section to the second channel section. The first channel section and the second channel section can be adjacent to each other. The first channel section can be located at an entrance of the nozzle 30, and/or the second channel section can be located at an outlet of the nozzle 30.

According to a further aspect, the second channel section can extend in the direction of the axis 2. According to a further aspect, the second channel section can have a substantially constant diameter over an axial length. The axial length can be at least 10 mm, specifically at least 20 mm. According to a further aspect, the second channel section can have a diameter of at least 5 mm and/or at most 15 mm.

According to a further aspect, the nozzle 30 can extend parallel to the axis 2 of the circuit breaker 1 and/or along (overlapping) the axis 2 and/or concentrically with the axis 2. According to a further aspect, the nozzle 30 can extend axially through the first contact 10, and/or the nozzle outlet can be formed by a hollow tip section of the first contact 10.

Next, aspects regarding the insulation gas are described.

By applying the swirl flow described herein to a circuit breaker 1, its thermal interruption performance can be significantly improved. This permits, for example, the use with an insulation gas being different from $SF_6$. $SF_6$ has excellent dielectric and arc quenching properties, and has therefore been conventionally used in circuit breakers. However, due to its high global warming potential, there have been large efforts to reduce the emission and eventually stop the usage of such greenhouse gases, and thus to find alternative gases by which $SF_6$ may be replaced.

Such alternative gases have already been proposed for other types of switches. For example, WO 2014154292 A1 discloses an $SF_6$-free switch with an alternative insulation gas. Replacing $SF_6$ by such alternative gases is technologically challenging, as $SF_6$ has extremely good switching and insulation properties, due to its intrinsic capability to cool the arc.

According to an aspect, the present configuration allows the use of an alternative gas (e.g. as described in WO 2014154292 A1) having a global warming potential lower than the one of $SF_6$ in a circuit breaker, even if the alternative gas does not fully match the interruption performance of $SF_6$.

The insulation gas can have a global warming potential lower than the one of $SF_6$ over an interval of 100 years. The insulation gas may for example include at least one background gas component selected from the group consisting of $CO_2$, $O_2$, $N_2$, $H_2$, air, $N_2O$, in a mixture with a hydrocarbon or an organofluorine compound. For example, the dielectric insulating medium may include dry air or technical air. The dielectric insulating medium may in particular include an organofluorine compound selected from the group consisting of: a fluoroether, an oxirane, a fluoramine, a fluoroketone, a fluoroolefin, a fluoronitrile, and mixtures and/or decomposition products thereof. In particular, the insulation gas may include as a hydrocarbon at least $CH_4$, a perfluorinated and/or partially hydrogenated organofluorine compound, and mixtures thereof. The organofluorine compound can be selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. The insulation gas can preferably include the fluoroketone mixed with air or an air component such as $N_2$, $O_2$, and/or $CO_2$.

In specific cases, the fluoronitrile mentioned above can be a perfluoronitrile, in particular a perfluoronitrile containing two carbon atoms, and/or three carbon atoms, and/or four carbon atoms. More particularly, the fluoronitrile can be a perfluoroalkylnitrile, specifically perfluoroacetonitrile, perfluoropropionitrile ($C_2F_5CN$) and/or perfluorobutyronitrile ($C_3F_7CN$). Most particularly, the fluoronitrile can be perfluoroisobutyronitrile (according to formula $(CF_3)_2CFCN$) and/or perfluoro-2-methoxypropanenitrile (according to formula $CF_3CF(OCF_3)CN$). Of these, perfluoroisobutyronitrile is particularly preferred due to its low toxicity.

The circuit breaker 1 can also include other parts such as nominal contacts, a drive, a controller, and the like, which have been omitted in the Figures and are not described herein. These parts are provided in analogy to a conventional circuit breaker 1.

Figure 8:
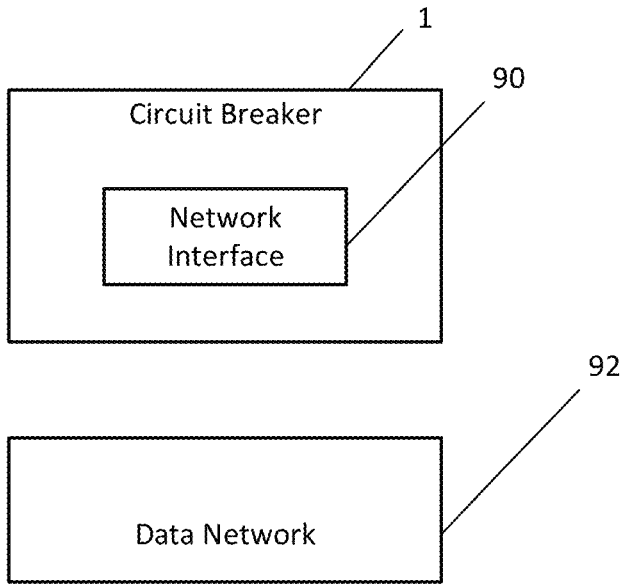
FIG. 8 is a block diagram according to some embodiments herein.

According to an aspect provided in FIG. 8, the circuit breaker 1 may further include a network interface 90 for connecting the device to a data network 92, in particular a global data network. The data network may be a TCP/IP network such as Internet. The circuit breaker 1 can be operatively connected to the network interface for carrying out commands received from the data network. The commands may include a control command for controlling the circuit breaker 1 to carry out a task such as a current breaking operation. In this case, the circuit breaker 1 can be adapted for carrying out the task in response to the control command. The commands may include a status request. In response to the status request, or without prior status request, the circuit breaker 1 may be adapted for sending a status information to the network interface, and the network interface can then be adapted for sending the status information over the network. The commands may include an update command including update data. In this case, the circuit breaker 1 can be adapted for initiating an update in response to the update command and using the update data.

The data network may be an Ethernet network using TCP/IP such as LAN, WAN or Internet. The data network may include distributed storage units such as Cloud. Depending on the application, the Cloud can be in form of public, private, hybrid or community Cloud.

According to a further aspect, the circuit breaker 1 can further include a processing unit for converting the signal into a digital signal and/or processing the signal.

According to a further aspect, the circuit breaker 1 can further include a network interface for connecting the device to a network. The network interface can be configured to transceive digital signal/data between the circuit breaker 1 and the data network. The digital signal/data can include operational command and/or information about the circuit breaker 1 or the network.

The invention claimed is:

1. A circuit breaker, comprising:

first and second contacts being configured to be moveable with respect to each other along an axis of the circuit breaker between an open and a closed configuration of the circuit breaker, the first and second contacts defining an arcing region in which an arc is formed during a current breaking operation;

a nozzle configured for directing a flow of a quenching gas onto the arcing region during the current breaking operation, a diffusor arranged downstream of the nozzle for further transporting the quenching gas within the arcing region and/or downstream of the arcing region, and a mechanical swirling device being arranged downstream of the nozzle and at least partially in the diffusor for imparting a swirl onto the quenching gas flowing along the diffusor, the mechanical swirling device having an axial overlap with the second contact in the open configuration of the circuit breaker, wherein the mechanical swirling device comprises mechanical swirling elements, that are integrally manufactured with the diffusor.

2. The circuit breaker according to claim 1, wherein the mechanical swirling device comprises mechanical swirling elements that include and/or are made from a same material as the nozzle and/or the diffusor, wherein the same material includes polytretafluoroethylene (PTFE).

3. The circuit breaker according to claim 1, wherein the mechanical swirling device comprises mechanical swirling elements, that are integrally manufactured with the diffusor by 3D printing.

4. The circuit breaker according to claim 1, the circuit breaker being configured for a rated operating voltage of at least 73 kV; and/or the circuit breaker being a high-voltage circuit breaker; and/or the first contact being a tulip-type contact and the second contact being a pin-type contact.

5. The circuit breaker according to claim 1, wherein the mechanical swirling device is arranged downstream of the nozzle at a distance from the nozzle.

6. The circuit breaker according to claim 1, wherein the mechanical swirling device is configured to create a centrifugal force on the flow of the quenching gas.

7. The circuit breaker according to claim 1, wherein the mechanical swirling device includes mechanical swirling elements, wherein the mechanical swirling elements are configured to mechanically deflect the flow of the quenching gas to deflect azimuthally to create the swirl of the quenching gas around an axial direction.

8. The circuit breaker according to claim 7, wherein the mechanical swirling elements include blades.

9. The circuit breaker according to claim 7, wherein the mechanical swirling elements include a first portion being connected to the diffuser and/or being inclined with respect to the axis and a second portion being substantially parallel to the axis, the first and second portions being continuously joined to each other.

10. The circuit breaker according to claim 7, wherein the diffusor and the mechanical swirling device are fixedly attached to the first contact.

11. The circuit breaker according to claim 7, wherein the mechanical swirling elements are arranged symmetrically with an n-fold rotational symmetry, around the axis; and/or the mechanical swirling elements are arranged with a constant or non-constant pitch.

12. The circuit breaker according to claim 7, wherein the mechanical swirling elements are fixed to the diffusor.

13. The circuit breaker according to claim 7, further comprising a support, wherein the support is configured to mount the mechanical swirling elements to the diffusor.

14. The circuit breaker according to claim 1, further comprising a network interface for connecting the circuit breaker to a data network, wherein the circuit breaker is operatively connected to the network interface for at least one of carrying out a command received from the data network and sending device status information to the data network.

15. A method of performing a current breaking operation by the circuit breaker according to claim 1, the method comprising:

separating the first and second contacts from each other by a relative movement away from each other along the axis of the circuit breaker, so that the arc is formed in the arcing region between the first and second contacts; and blowing a swirl flow of the quenching gas onto the arcing region.

16. The method according to claim 15, wherein blowing the swirl flow of the quenching gas onto the arcing region comprises directing the flow of the quenching gas using the nozzle and the mechanical swirling device.

17. The method according to claim 16, wherein the mechanical swirling device is arranged downstream of the nozzle.

18. The method according to claim 16, wherein the mechanical swirling device includes a plurality of mechanical swirling elements that mechanically deflect the flow of quenching gas from the nozzle to create the swirl of the quenching gas around an axial direction.

19. The method according to claim 18, wherein the mechanical swirling elements are arranged symmetrically with an n-fold rotational symmetry, around an axis; and/or the mechanical swirling elements are arranged with a constant or non-constant pitch.

20. The method according to claim 15, further comprising connecting the circuit breaker to a data network, wherein the circuit breaker is operatively connected to network interface for at least one of carrying out a command received from the data network and sending device status information to the data network.

* * * * *